US005849232A

United States Patent [19]

Ochi et al.

[11] Patent Number: 5,849,232

[45] Date of Patent: Dec. 15, 1998

[54] PROCESS FOR PRODUCING HIGHLY ORIENTED UNDRAWN POLYESTER FIBERS

[75] Inventors: Takashi Ochi; Akira Kishiro; Mototada Fukuhara; Atsushi Taniguchi, all of Shizuoka; Takeshi Kikutani, Tokyo, all of Japan

[73] Assignee: Toray Industries, Inc., Japan

[21] Appl. No.: 843,009

[22] Filed: Apr. 11, 1997

Related U.S. Application Data

[62] Division of Ser. No. 608,468, Feb. 28, 1996, Pat. No. 5,660,804.

[30] Foreign Application Priority Data

Mar. 2, 1995 [JP] Japan ..... 7-042650
Dec. 27, 1995 [JP] Japan ..... 7-340858

[51] Int. Cl.[6] ..... D01D 5/34; D01F 8/04; D01F 8/14

[52] U.S. Cl. ..... 264/172.15; 264/172.17; 264/172.18

[58] Field of Search ..... 264/172.15, 172.17, 264/172.18

[56] References Cited

U.S. PATENT DOCUMENTS 3,316,336 4/1967 Smith .
3,803,453 4/1974 Hull .
4,156,071 5/1979 Knox .
4,442,057 4/1984 Brody .
4,518,744 5/1985 Brody .
4,833,032 5/1989 Reese .
5,034,174 7/1991 Reese .
5,318,845 6/1994 Tanaka et al. .

FOREIGN PATENT DOCUMENTS

WO-A-93/19231 9/1993 WIPO .

OTHER PUBLICATIONS

"Fiber Structure Formation in High–Speed Melt Spinning of Sheath–Core Type Biocomponent Fibers," Takeshi Kikutani et al, *Sen–I Gakkaishi,* vol. 51, pp. 408–415 (May 8, 1995).

*Primary Examiner*—Leo B. Tentoni
*Attorney, Agent, or Firm*—Austin R. Miller

[57] ABSTRACT

A process for preparing highly oriented undrawn core-sheath type conjugated polyester fibers including the step of spinning a polyester as the sheath polymer and a polymer having a larger gradient of elongational viscosity with the temperature than that of the sheath polymer as a core polymer at a spinning speed of about 4000 to 12000 m/min.

8 Claims, 3 Drawing Sheets

(a) : Example No. 2 (Polystyrene 5wt%, 6000m/min)
(b) : Example No. 10 (Polymethylmethacrylate 5wt%, 6000m/min)
(c) : Example No. 14 (PET, 3500m/min)

PROCESS FOR PRODUCING HIGHLY ORIENTED UNDRAWN POLYESTER FIBERS

This is a divisional of application Ser. No. 08/608,468, filed Feb. 28, 1996, which issued as U.S. Pat. No. 5,660,804 on Aug. 26, 1997.

FIELD OF THE INVENTION

The present invention relates to highly oriented undrawn polyester fibers, in more detail, fibers ideal for clothing and industrial materials as a flat yarn, twisted yarn or draw-falsetwist textured yarn.

BACKGROUND OF THE INVENTION

Polyester fibers are widely used for clothing and industrial materials because of their various excellent mechanical and other properties. Among them, polyethylene terephthalate (PET) is a typical polyester used for general purposes.

In recent years, a high speed spinning method for obtaining practical PET fibers in one step at a high take-up speed of 5000 m/min or more without drawing has been industrially adopted. Since the productivity in the step of spinning greatly depends on the quantity discharged per unit time, a higher spinning speed can achieve a higher productivity in the one-step method. However, for example, PET fibers show practically preferable mechanical properties when they are spun at a high speed of 6000 to 7000 m/min, but at higher speed, the strength and elongation of the fibers are lowered. Therefore, there is a limit to the spinning speed which can sufficiently exhibit the effect of productivity improvement.

In this regard, it has been proposed to blend a small amount of a polymer incompatible with the matrix polymer for spinning. For example, Japanese Patent Laid-Open Nos. 58-98414 and 60-209015 disclose spinning methods for controlling the molecular orientation by adding 0.1 to 10 wt % of a polymer incompatible with the matrix polymer. Furthermore, Japanese Patent Laid-Open No. 57-11211 discloses a method of adding a liquid crystal polymer. Moreover, Japanese Patent Laid-Open Nos. 56-91013, 57-47912 and 62-21817 disclose methods for controlling the molecular orientation by adding a small amount of a polyolefin based polymer to a polyester.

However, in these methods, the added polymer exerts adverse influence even though the molecular orientation is controlled. For example, when a polymer having low softening temperature such as polystyrene is added, the added polymer existing in the surface layer of fibers may adhere to each other during the falsetwist texturing under a high temperature. In addition, the coloring of dyed fibers may be poor. Moreover, it is very difficult to homogeneously blend a small amount of a different polymer with a polyester. The lack of homogeneity in the blend may cause frequent fiber breakage and the fabrics may not be sufficient in color uniformity after dyeing.

In applications for clothing, falsetwist textured yarns are usually used to provide moderate bulk to a fabric. Recently, draw texturing has become a common process, where highly oriented undrawn fibers, for example, a so-called partially oriented yarn (POY) is one of them, are simultaneously drawn and falsetwisted.

To improve the process stability and processing speed in the draw texturing process, the ballooning of the yarn along the thread line must be stabilized. It is known that this purpose can be achieved at a higher twist tension, and/or a higher drawing ratio and the use of more highly oriented fibers. However, if the drawing ratio is increased to an excessively high value or if excessively highly oriented fibers are used, fluff and frequent fiber breaking occur, thereby lowering the quality of the textured yarns obtained, and disadvantageously inconveniencing the operation. Therefore, in general, the upper limit of the spinning speed for the undrawn yarn which can be textured with a moderate twist tension is about 4000 m/min.

Furthermore, in the melt spinning of a polyester, it is known that at a higher than critical spinning speed, neck-like deformation occurs on the spinning line, to cause orientation and crystallization, and that fibers similar to the conventional drawn fibers can be obtained. For example, it is well known that the critical spinning speed of PET is about 4000 to 5000 m/min. Since the fibers obtained at higher than the critical spinning speed are not the so-called POY, they cannot be processed by draw texturing under a draw ratio of, for example, from 1.2 to 2.0, even though they can be textured without being drawn.

The draw texturing process has a feature that highly oriented undrawn yarn with a large denier corresponding to the drawing ratio can be spun at a high speed. Therefore, a high productivity in spinning can be realized. Heretofore, polyester fibers spun at a spinning speed higher than 4000 m/min could not be stably processed by draw texturing.

The conventional POY is little crystallized as can be seen from its boil off shrinkage of higher than 50% and the absence of the wide angle X-ray diffraction peak, which would have indicated the presence of a crystallization of the polyester. For this reason, the fiber structure is unstable and changes depending upon storage conditions. The storage time of POY must be controlled to be constant to keep uniformity in dyeing. Furthermore, since the structural change of the fibers during storage is different between the inner portion and the outer portion of each package, the quality is uneven disadvantageously. Therefore, to keep uniform quality, heat treatment at a certain elevated temperature must be needed.

One of the objects of the present invention is to provide highly oriented undrawn polyester fibers which at most exhibit only a small change in fiber structure during storage, which, due to their stable structure, have good processability in draw texturing, and are capable of contributing to the improvement of productivity. The other object of the present invention is to provide highly oriented undrawn polyester fibers capable of contributing to the improvement of productivity by increase of output. Another object of the present invention is to provide a falsetwist textured yarn obtained from said highly oriented undrawn polyester fibers, and a process for producing the same.

SUMMARY OF THE INVENTION

The above mentioned objects of the present invention can be achieved by highly oriented undrawn polyester fibers, which is crystalline such that the fibers are capable of exhibiting diffraction peaks observable in a wide angle X-ray diffraction peak image of the fibers, and have a birefringence of about 0.015 to 0.05 and the process for producing the same.

DETAILED DESCRIPTION OF THE INVENTION

The first feature of the present invention is that the highly oriented undrawn polyester fibers of the present invention are capable of exhibiting diffraction peaks observable in a wide angle X-ray diffraction image of the fibers. Therefore, the fiber structure is stable during storage, and a drawing ratio in the draw texturing of the fibers can be as large as conventional POY. Furthermore, the twist tension can be highly controlled.

The diol component and the acid component of the polyester can be substituted by another copolymerizable component up to 15 mol % respectively. The polyester can also contain such additives as a delustering agent, flame retarding agent, antistatic agent and a pigment.

There have been many studies concerning the high speed spinning method of polyesters, especially of PET. For example, according to Shimizu, et al. (*Journal of Textile Machinery Society*, Vol. 38, p. 243 (1985)), up to a spinning speed of 4000 m/min, the fiber is not deformed like a neck on the spinning line, and the fiber shows amorphous structure in the wide angle X-ray diffraction analysis. The fiber spun at a speed higher than 5000 m/min at which neck-like deformation occurs shows the diffraction peak due to the crystalline portion of the polyester. Therefore, it can be said that since the spinning speed of conventional PET POY is less than 4000 m/min, the fiber is amorphous in the evaluation by wide angle X-ray diffraction.

Figure 1:
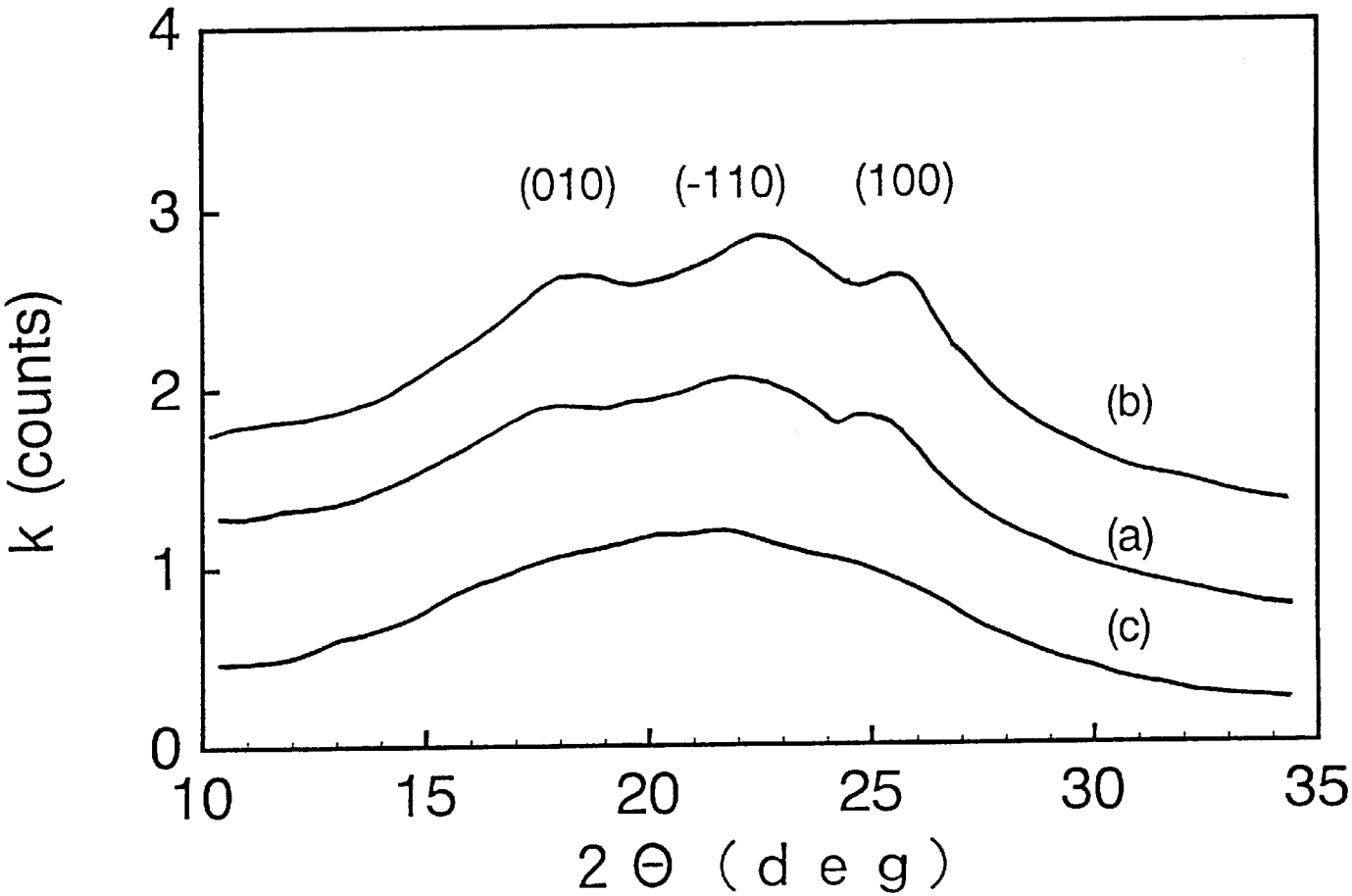
FIG. 1 is a diagram showing intensity distributions in the equatorial direction of wide angle X-ray diffraction images of the fibers of the present invention.

On the contrary, the highly oriented undrawn fibers of the present invention show the peaks corresponding to the diffraction angle of PET crystals in the equatorial intensity distribution of its wide angle X-ray diffraction image (FIG. 1). That is, it is shown that the oriented crystals of PET exist. However, since the peaks are weak in intensity compared to the peaks of the conventional drawn fibers, it is estimated that the amount of crystals is small.

The birefringence of the highly oriented undrawn fibers of the present invention is 0.015 to 0.05. If the birefringence is lower than 0.015, it is difficult to string up the yarn at the start of draw texturing and the fibers obtained tend to adhere to each other. On the other hand, if higher than 0.05, the twist tension is so high as to cause fluff and frequent fiber breaking unpreferably. A preferable range of birefringence is 0.02 to 0.045. The birefringence of the highly oriented undrawn fibers of the present invention is 0.05 or less, about the same as or lower than that of the conventional POY. Therefore, the fibers of the present invention are estimated to have a new structure which has never been imagined before, that the amorphous POY structure is dotted with a very small amount of crystals. The birefringence referred to here is the birefringence due to the orientation of the polyester.

The boil off shrinkage percentage of the fibers is preferably about 10 to 50%. In this range, since oriented crystallization does not progress so much, the drawability and thermosettability in the draw texturing process are good. Furthermore, if the shrinkage percentage is in this range, the polyester crystals as a feature of the present invention are properly developed, to stabilize the fiber structure keeping its change during storage small. The boil off shrinkage is more preferably about 20 to 50%.

In general, amorphous fibers high in their degree of orientation show a high boil off shrinkage corresponding to the degree of orientation. If the degree of orientation becomes so high as to initiate the formation of crystal nuclei, the boil off shrinkage reaches a ceiling, and at a higher degree of orientation with further crystallization caused, the boil off shrinkage declines suddenly. As described here, the crystallinity of fibers is well reflected by the boil off shrinkage.

Figure 2:
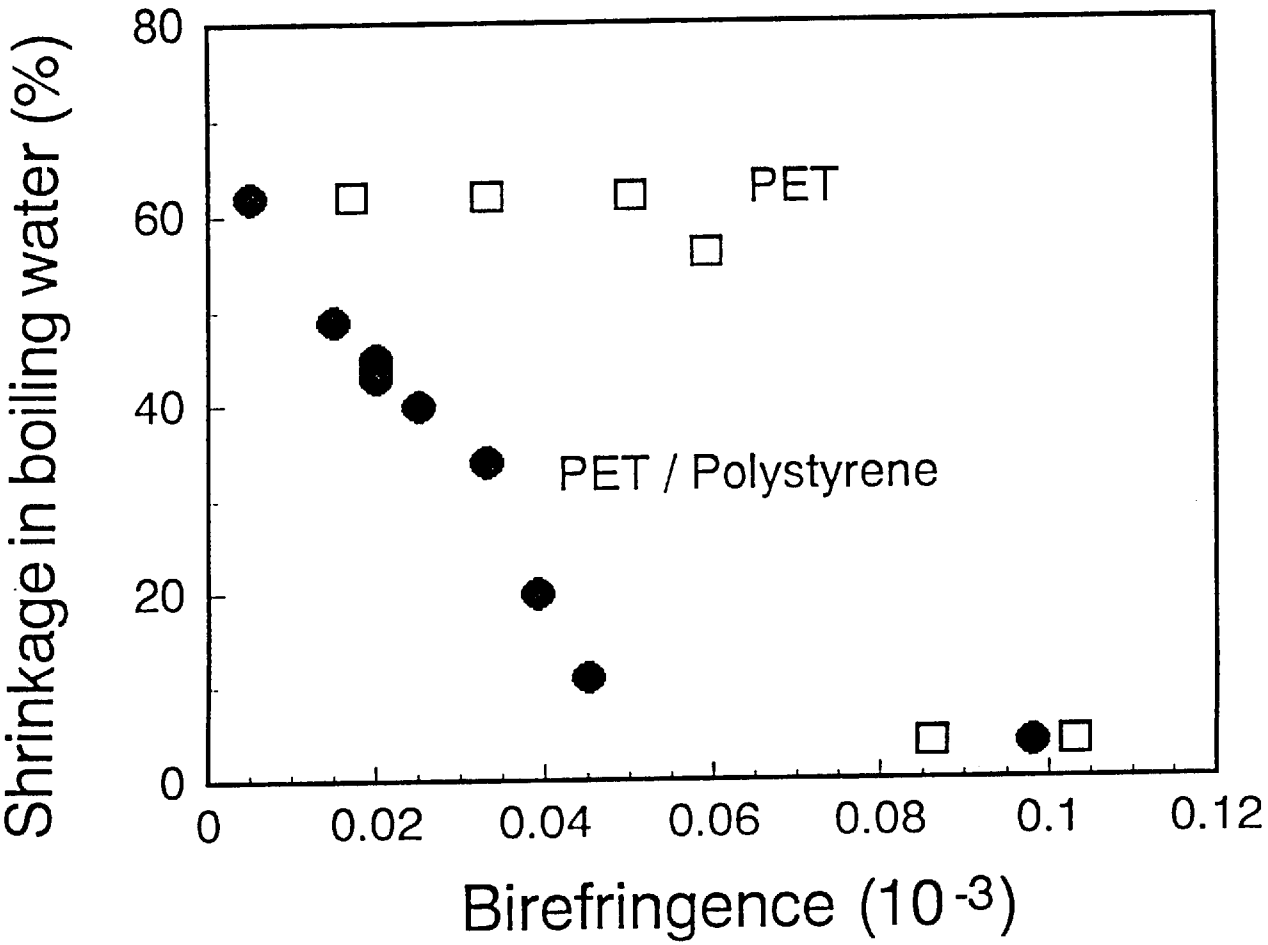
FIG. 2 is a diagram showing the relation between the birefringence and the boil off shrinkage percentage of fibers obtained by using polystyrene (Styron 685) as the core polymer (closed circles) and the fibers obtained by using PET only as the polymer (open squares).

The relationships between the birefringence and the boil off shrinkage of ordinary PET fibers and the fibers of the present invention are shown in FIG. 2. In the case of ordinary PET, the boil off shrinkage declines suddenly when the birefringence is in a range from about 0.075 to 0.085, but in the case of the fibers of the present invention, the boil off shrinkage begins to decline greatly at a birefringence of about 0.015, and further suddenly declines in a range from about 0.035 to 0.045. This shows that the fibers of the present invention begin to be crystallized already when the birefringence is still low, compared with ordinary PET. This agrees with the fact that the wide angle X-ray diffraction peak is due to the crystallization of the polyester.

In conventional fibers, the degree of crystallinity is almost 0% at a birefringence of 0.05, but in the highly oriented undrawn fibers of the present invention, the degree of crystallinity is 10% at a birefringence of 0.033 (Experiment No. 2). This shows that crystals are produced already at a low degree of orientation, and agrees with the fact that the wide angle X-ray diffraction peak is due to the crystallization of the polyester. In the present invention, the value of the degree of crystallinity of a polyester is determined by Raman spectroscopy. It is stated in *J. Polym. Sci.*, Vol. 10, 317 (1972) that the half value width of the peak at 1730 $cm^{-1}$ due to the carbonyl portion of a polyester is inversely proportional to the density of the polyester. The half value width of the peak at 1730 $cm^{-1}$ was obtained by Raman spectroscopic analysis, and the degree of crystallinity was calculated from the density determined by it.

As described above, the fibers of the present invention have a feature that crystals coexist in an amorphous structure as large as the conventional POY in the degree of orientation. That is, it is surmised that a stable network structure is formed, in which amorphous sea is dotted with a very small amount of crystals. Because of this, it is estimated that the change of the fiber structure during storage is small, and that the twist tension becomes higher than that of the conventional POY during deformation in the draw texturing process. Thus, the process stability and processability in the draw texturing process is improved, and the processing speed can be raised.

The elongation at break of the highly oriented undrawn fibers of the present invention is preferably 100 to 250%. In this range, it is easy to string up the fibers in the draw texturing process, and any non-untwisted spots due to adhesion, fluff and fiber breaking do not occur. Furthermore, the drawing ratio can be set as high as that of conventional POY. Moreover, the draw textured yarn obtained is less deformed in the cross section, and is free from rough feeling and shows moderate luster. A more preferable elongation range is 100 to 200%. The highly oriented undrawn fiber with such high drawing potential can enhance the productivity in spinning.

The second feature of the present invention is a process for producing highly oriented undrawn core-sheath type conjugated polyester fibers. The sheath component is a polyester. The gradient of elongational viscosity with the temperature of the core polymer used for the present invention is larger than that of the sheath polyester. The spinning speed in the present invention is from 4000 to 12000 m/min.

The gradient of elongational viscosity with the temperature can be compared, for example, as described below. The polymers to be compared are spun separately under the same spinning conditions (spinning machine, pack, nozzle hole diameter, number of filaments, cooling condition, spinning speed, etc.), to be the same in final fiber diameter, and the respective fiber speeds or fiber diameters are measured along the spinning line. The polymer which is deformed more upstream (closer to the nozzle face) in the spinning line can be judged to have larger gradient of elongational viscosity with the temperature.

Polymers, the gradient of elongational viscosity with the temperature of which are larger than that of the polyesters to be used, for example, PET include polystyrene, polymers of styrene derivatives such as (α-methylstyrene, p-methoxystyrene and chlorostyrene, copolymers with styrene, polystyrene based polymers such as styrene-acrylonitrile copolymer, polyacrylate based polymers such as polymethyl methacrylate, polyethyl methacrylate, polypropyl methacrylate, polybutyl methacrylate and polyethylhexyl methacrylate, acrylate-styrene copolymers as copolymers of these polyacrylate based polymers and polystyrene based polymers, polymethylpentene, and polymethylpentene based polymers obtained by copolymerizing methylpentene and an olefin, etc. Among them, polystyrene, polymethyl methacylrate and polymethylpentene are preferable in view of handling convenience and the orientation control effect described later. Polystyrene is especially preferable.

Considering the balance of the fiber properties, the amount of the core-polymer in the conjugated fiber of the present invention is preferably from about 1 to 15 wt %. If the amount is more than about 15 wt %, the influence of the core polymer may be exerted to make the fiber poor in mechanical properties. If the amount is less than about 1 wt %, the residence time in the spinning machine and pack is so long as to make the polymers thermally deteriorated unpreferably. A more preferable range is about 2 to 7 wt %. In the present invention, as the core polymer, any of said polymers can be used singly or blended with the polyester used as the sheath polymer or any other polymer. When any polymer is blended with the specific polymer having a larger gradient of elongational viscosity with the temperature, the content of the specific polymer in the blend is preferably about 30 to 70 wt %. It is preferable to conjugate so that the content of the specific polymer in the entire conjugated fiber becomes about 1 to 15 wt %. The conjugated amount in the blend refers to the content based on the entire conjugated fiber.

The cross-sectional form of the fiber and the conjugated form of sheath and core are not especially limited. Plural cores may be adopted to form a structure of sea and island. However, usually, considering the decline of spinnability caused by the bending of the discharged fiber, it is preferable to avoid eccentricity and to arrange substantially symmetrically with reference to the fiber axis. What is important in the present invention is that the core polymer is conjugated as the core in the sheath, without being exposed on the surface of the fiber. Japanese Patent Publication No. 43-23879 discloses core-sheath type conjugated fibers consisting of a thermoplastic amorphous polymer as the core and a thermoplastic crystalline polymer as the sheath. However, it simply shows a yarn of core/sheath=amorphous polymer/crystalline polymer. It does not state or suggest anything about the combination of polymers different in the gradient of elongational viscosity with the temperature. In addition, the technique is characterized by cold-drawing a fiber spun at a low speed, for discontinuity of the core polymer, and there is no control of the molecular orientation by high speed spinning. Furthermore, the amount of the conjugated core polymer is 20 wt % or more based on the weight of the entire conjugated fiber. If the technique is applied to a polyester, the spun fiber obtained is smaller than 0.015 in birefringence and larger than 50% in boil off shrinkage. So, the present invention is quite different from the invention disclosed in said Japanese Patent Publication No. 43-23879.

Considering the process stability and processability in the draw texturing process, it can be considered to be better that the fibers obtained are oriented to some extent. For this reason, the spinning speed is preferably about 4000 m/min to 12000 m/min, more preferably about 4000 m/min to 9000 m/min, further more preferably about 5000 m/min to 9000 m/min. If the spinning speed is higher than about 12000 m/min, the fiber obtained may decline in residual elongation, to inconvenience such working as winding.

If the core-sheath type conjugation spinning is effected, the orientation of the sheath polyester is controlled, and the highly oriented undrawn fiber can be obtained even by high speed spinning. The orientation control mechanism is considered to be as described below.

Since the core polymer has a larger gradient of elongational viscosity with temperature, it is prone to become fine earlier (more upstream in the spinning line) than the sheath polyester. So, the sheath polyester is deformed to follow the deformation of the core polymer. That is, compared with the case of spinning the sheath polyester alone, the sheath polyester is forcibly deformed at a higher temperature (when the elongational viscosity is lower), and the spinning stress during deformation is lower than that in the case of spinning the polyester itself without core polymer. Since the spinning stress during deformation decides the orientation of the polymer, the orientation of the sheath polymer is controlled as a result. The degree of orientation control effect depends on the difference between the energy for the core polymer to deform at the temperature and the energy required for deforming the sheath polyester.

Therefore, if the gradient of elongational viscosity with the temperature of the core polymer and its absolute value are higher than those of the sheath polyester, the deformation is caused when the sheath polyester is lower in elongational viscosity, i.e., higher in temperature. Moreover, since large energy is given to the sheath polyester as a result, the orientation control effect is large. Furthermore, if the amount of the conjugated core polymer is larger, the orientation control effect is larger. Thus, the highly oriented undrawn fiber of the present invention can be obtained in a far higher spinning speed range of about 4000 to 12000 m/min than the conventional POY.

It is also an advantage of the present invention that the so-called POY can be produced at an efficiency of about double compared to the conventional POY. The highly oriented undrawn fiber of the present invention can also be obtained by ultrahigh speed spinning at higher than about 12000 m/min by selecting the polymer adopted as the core and its conjugated amount to increase the orientation control effect as described above. However, since the equipment such as an ultrahigh speed winder suitable for winding the undrawn fiber at a speed higher than about 12000 m/min is costly, higher productivity will be decreased.

Moreover, since the polyester fibers with the new structure intended in the present invention are formed under the orientation control mechanism as described above, it is desirable to properly select the amount of the conjugated core polymer, for obtaining an optimum orientation control effect at the intended spinning speed by the polymers used.

It is reported in Sen-i Gakkaishi, Vol. 51, p. 408 (1995) that core-sheath type conjugated fibers consisting of PET as the core and 50 wt % of polystyrene as the sheath are lowered in the orientation of PET. However, the technique is different from that of the present invention, since the wide angle X-ray diffraction photos do not show the existence of crystals. Moreover, the technique does not state the boil off shrinkage of the conjugated fibers obtained or drawing at all. Furthermore, if the conjugated fibers with polystyrene as the sheath are simultaneously drawn and falsetwisted at a high temperature, fusion occurs in the polystyrene portion, not allowing the object of the present invention to be achieved. In addition, it is very difficult to draw polyester fibers with a large amount of polystyrene conjugated as used in that technique.

For example, it is disclosed in Japanese Patent Laid-Open No. 50-157617, etc. that if undrawn polyester fibers with 30 wt % of polystyrene as the core are drawn, the core polystyrene is partially cut and becomes uneven in thickness. Therefore, if undrawn conjugated polyester fibers with polystyrene as the sheath are drawn, the sheath is broken, and no satisfactory fibers can be obtained. In this regard, in the present invention, since the specific polymer is small in amount and confined as the core component of the fibers, they can be drawn like the conventional POY, and such troubles as fusion do not occur during false twisting.

If the highly oriented undrawn polyester fibers obtained in the present invention are draw textured, the process stability and processability are improved advantageously as described before. Furthermore, since the twist tension can be set at a high value, the processing speed can be raised, to also improve the productivity in the draw texturing process. Moreover, thus obtained textured yarn shows good crimp characteristic as the conventional textured yarn, and it is advantageously smaller in density, lighter in weight and higher in heat resistance because of higher melting point than the conventional POY.

The polyester fibers obtained in the present invention can be ideally used for clothing as a flat yarn, twisted yarn or textured yarn. They can also be used for industrial materials.

EXAMPLES

The present invention is now described in more detail with reference to the following examples. The measuring methods of the polymer and filament properties employed in the examples are as described below.

A. Intrinsic viscosity [η]

Measured in orthochlorophenol at 25° C.

B. Tensile strength and elongation at break

According to JIS L 1013, a load-elongation curve was obtained at a sample length of 50 mm at a cross head speed of 50 mm/min using a tensile testing machine produced by Orienteck. Then, the load was divided by the initial denier (thickness) of the fiber, to be expressed as the strength, and the elongation was divided by the initial sample length, to be expressed as the elongation.

C. Boil off shrinkage

A yarn in skein form was immersed in 98° C. boiled water for 15 minutes, and the lengths before and after the immersion were measured, to calculate the boil off shrinkage from the following formula:

$$\text{Boil off shrinkage}=[(\text{Length before immersion}-\text{Length after immersion})/\text{Length before immersion}]\times 100$$

D. Wide angle X-ray diffraction

Model 4036A2 X-ray generator produced by Rigaku Denki was used for measuring in the equatorial direction with CuKα rays (using an Ni filter) as the ray source. The output was 40 kV and 20 mA, and the slit system was 2 mm in diameter. The integrating time was 2 seconds.

The diffraction intensity curve obtained was processed to be made smooth according to Savitzky and Golay's smooth method (*Analytical Chemistry*, Vol. 36 (8), 1627 (1964)).

E. Birefringence of polyester

Figure 3:
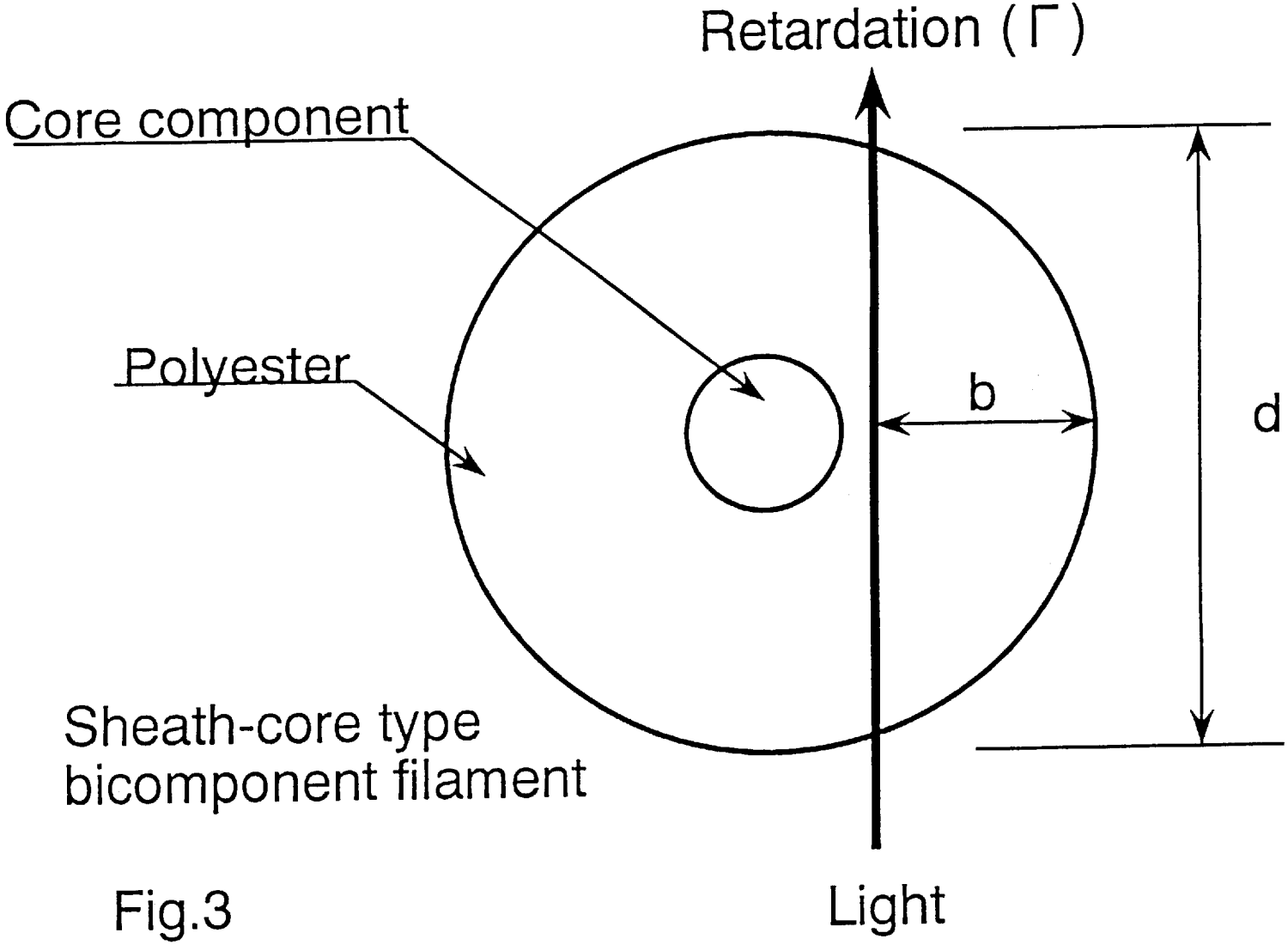
FIG. 3 is a drawing showing a typical method of measuring the birefringence of the polyester portion.

The birefringence of the polyester portion was obtained as described below (FIG. 3), using a BH-2 polarization micrometer produced by Olympus. From the retardation Γ near the interface between the sheath polyester and the core polymer and the optical path length d of the polyester portion, the birefringence of the polyester portion was calculated as Γ/d. The optical path length d was calculated at the retardation measuring position located at a distance b from the surface of the filament. In the case of a filament made of a polyester alone, it was obtained from Γ at the center of the filament and the filament diameter.

F. Degree of crystallization of polyester

For the degree of crystallization (c) of the polyester, the half value width (Δν) at 1730 $cm^{-1}$ was obtained from Raman spectropic analysis, and the density (ρ) was determined from it. Then, the degree of crystallization was calculated using the following equation.

$$\rho=(305-\Delta\nu)/209$$

$$c=100\times(\rho-1.335)/(1.455-1.335)$$

In the above, the density of the perfectly amorphous polyester was assumed to be 1.335 $g/cm^3$, and the density of the perfectly crystalline polyester, 1.455 $g/cm^3$.

The Raman spectrum was analyzed by applying a laser beam onto the lateral side of the filament with $Ar^+$ laser (514.5 nm) as the light source by Jobin Yvon Ramanor T-64000.

G. Melting point

The melting point was measured by differential scanning calorimetry (DSC). The measurement steps were as follows. The sample was chopped fine, allowed to shrink freely and measured by DSC-2C produced by Perkin Elmer. The heating rate was 16° C./min, and the weight of the sample was 10 mg.

H. Crimp rigidity (CR)

The yarn was wound 5 turns on a spool to make a skein, and it was allowed to freely shrink in 90° C. water for 20 minutes. Then, the skein was taken out of the water and dried in air overnight. Subsequently in 20° C. water, an initial load and an additional load were applied to the skein, and two minutes later, the length of the skein was measured ($L_0$). The additional load was immediately removed, and further two minutes later, the length of the skein was measured in water ($L_1$). From the following formula, the crimp recovery rate was calculated as CR value.

$$CR=(L_0-L_1)/L_0\times 100(\%)$$

The initial load was (Number of deniers of filament)×5×2/25 grams, and the additional load was (Number of deniers of filament)×2 grams.

I. Color uniformity after dyeing

The textured yarn was knitted into a fabric which was dyed by a blue disperse dye, and the color uniformity was visually judged.

J. Density of textured yarn

The density of the textured yarn as a whole was measured by density gradient tubes of sodium bromide aqueous solutions at 25° C.

Example 1

PET of 0.63 in intrinsic viscosity and polystyrene (Styron 685 produced by Asahi Chemical Industry Co., Ltd.) as a polymer having the larger gradient of elongational viscosity on temperature than that of PET were selected. These two polymers were made molten separately, being filtered by a stainless steel nonwoven fabric filter of 10 $\mu$m in absolute filtration diameter. Then, the polystyrene and PET were discharged from a die with 36 concentric holes for conjugating polystyrene as the core and PET as the sheath. The amount of polystyrene conjugated in this case was 5 wt %. The spinning temperature was 295° C., and the discharged amount was adjusted to be 90 g/min as total of core and sheath. The discharged filaments were cooled, oiled, interlaced, and wound by a winder through a take-up roller according to conventional methods. The speeds of the take-up roller are shown as spinning speeds in Table 1 (Nos. 1 and 2). The birefringences, boil off shrinkages and elongations of the samples are shown in Table 1. Furthermore, the relation between the birefringence of the PET portions and the boil off shrinkage is shown in FIG. 2.

In both the cases, the wide angle X-ray diffraction peaks due to the crystallization were observed in the halo, to show that PET crystals exist. The diffraction intensity curve in the equatorial direction of the fibers spun at a speed of 6000 m/min (No. 2) is shown as curve (a) in FIG. 1. The degree of crystallization was 10% in the case of the fibers spun at a speed of 6000 m/min (No. 2) while that of the conventional POY (No. 15) was 0%. Also from this, it can be confirmed that the fibers were crystallized, and the crystals stabilized the fiber structure. Even though crystals existed, the birefringence of the PET portion was low, to show that orientation did not progress, as can be confirmed from Table 1. Therefore, the fibers obtained are highly oriented undrawn fibers, which show large in elongation and capable of being drawn. It can be seen that the so-called POY can be produced by high speed spinning for contribution to the enhancement of productivity.

Example 2

Fibers were melt spun under the similar conditions as shown in Example 1, except that polystyrene used was Denka Styrol MT-2 produced by Denki Kagaku Kogyo K. K. and that the spinning speed was as shown in Table 1 (Nos. 3 to 6). The birefringences, elongations and boil off shrinkages are shown in Table 1. At every spinning speed, the wide angle X-ray diffraction peaks due to the crystallization of PET were observed in the halo, to show that PET crystals existed. Even though crystals existed, the birefringence of the PET portion was low, to show that orientation did not progress, as can be confirmed from Table 1.

Example 3

Fibers were melt spun under the similar conditions as shown in Example 1, except that the amount of polystyrene and spinning speed were changed as shown in Table 1 (Nos. 7 to 9). The birefringences, elongations and boil off shrinkages are shown in Table 1. Also in these cases, the wide angle X-ray diffraction peaks due to the crystallization of the polyester were observed in the halo, to show that the crystals of PET existed. Even at spinning speeds of 10000 m/min or more, the fibers intended in the present invention could be obtained.

Example 4

Fibers were melt spun under the similar conditions as shown in Example 1, except that polymethyl methacrylate (Sumipex LG produced by Sumitomo Chemical Co., Ltd.) was used instead of polystyrene (No. 10). The birefringence, elongation and boil off shrinkage are shown in Table 1. The wide angle X-ray diffraction intensity curve in the equatorial direction is shown as curve (b) in FIG. 1. Even if polymethyl methacrylate was used as the core component, the wide angle X-ray diffraction peaks due to crystallization of PET were observed, to show that fibers intended in the present invention could be obtained.

Example 5

Fibers were melt spun under the similar conditions as shown in Example 1, except that polymethylpentene ("TPX" RT18 produced by Mitsui Petrochemical Industries, Ltd.) was used instead of polystyrene, and that its amount conjugated was 3 wt % (No. 11). The birefringence, elongation and boil off shrinkage are shown in Table 1. Also in this case, the wide angle X-ray diffraction peaks due to the crystallization of PET were observed in the halo, and it can be seen that even if polymethylpentene is used, fibers of the present invention can be obtained.

Comparative Example 1

Fibers were melt spun under the similar conditions as shown in Example 1, except that the polymer used was only the PET used in Example 1 (Nos. 12 to 17). At every spinning speed, properties of typical PET fibers are shown. At spinning speeds of 5000 m/min or higher, remarkable oriented crystallization occurred, and the boil off shrinkage suddenly declined. The birefringences, boil off shrinkages, and residual elongations are shown in Table 1. The wide angle X-ray diffraction curve in the equatorial direction of the fibers obtained at a spinning speed of 3500 m/min (No. 14) is shown as curve (c) in FIG. 1, no diffraction peak due to PET crystal is observed. Samples of Examples 12 and 13 (lower spinning speeds) also show no diffraction peak. Furthermore, the relation between the birefringence and the boil off shrinkage is shown in FIG. 2. The degree of crystallization at a spinning speed of 3500 m/min (No. 14) was 0% and agreed with the fact that only an amorphous halo was observed in its wide angle X-ray diffraction curve.

Comparative Example 2

Fibers were melt spun under the similar conditions as shown in Example 1, except that polyethylene (Sumikathene L produced by Sumitomo Chemical Co., Ltd.) having the smaller gradient of elongational viscosity with the temperature smaller than that of PET was used instead of polystyrene (No. 18). Fully oriented crystallization occurred, and the wide angle X-ray diffraction peaks due to the crystallization of PET were observed. However, the birefringence was as high as 0.085, and fibers as intended in the present invention could not be obtained.

Example 6

Fibers were melt spun under the similar conditions as shown in Example 1, except that the amount of polystyrene (Styron 685 produced by Asahi Chemical Industry Co., Ltd.) was changed in a range from 1 to 10 wt % and that the spinning speed was 6000 m/min. The birefringences, elongations and boil off shrinkages are shown in Table 1. When the amount of polystyrene was larger, the effect of controlling the orientation of PET was higher. The relation between the birefringence and the boil off shrinkage is shown in FIG. 2. When the amount of polystyrene is in this range, the wide angle X-ray diffraction peaks due to the crystallization of PET were observed in the halo, to show that PET crystals existed. From the results, it can be seen that when the amount of polystyrene is in this range, fibers as intended in the present invention can be obtained.

Comparative Example 3

Fibers were melt spun under the similar conditions as shown in Example 1, except that the amount of polystyrene (Styron 685 produced by Asahi Chemical Industry Co., Ltd.) was 0.5 or 17 wt %, and that the spinning speed was 6000 m/min (Experiment Nos. 22 and 23). The birefringences, elongations and boil off shrinkages are shown in Table 1. The relation between the birefringence and the boil off shrinkage is shown in FIG. 2. When the amount was 0.5 wt %, fully oriented crystallization occurred, and the wide angle X-ray diffraction peaks due to the crystallization of PET, even though the birefringence was as high as 0.098. On the other hand, when the amount was 17 wt %, no diffraction peaks due to the crystallization of PET were observed. From the results, it can be seen that when the amount of polystyrene is too large or too small, fibers as intended in the present invention cannot be obtained.

Example 7

The highly oriented undrawn fibers obtained in Example 1 (No. 2 at a spinning speed of 6000 m/min) were draw textured at a heater temperature of 215° C., at a twister speed of 6800 rpm and at a drawing ratio of 1.8 times. The results obtained at a processing speed of 700 m/min are shown in Table 2. The results obtained at a processing speed of 1500 m/min are shown in Table 3. As can be seen from the tables, if the highly oriented undrawn fibers of the present invention are used, a textured yarn low in density and high in heat resistance can be obtained. In addition, since the twist tension was high, the process stability and processability were good and the color uniformity of the textured yarn obtained after dyeing were also good even if the processing speed was raised. Thus, the present invention could contribute to the enhancement of productivity not only in the spinning step but also in the draw texturing step.

Comparative Example 4

The highly oriented undrawn fibers of PET only obtained in Comparative Example 1 (No. 14 at a spinning speed of 3500 m/min) were falsetwisted under the same conditions as in Example 7. The results obtained at a processing speed of 700 m/min are shown in Table 2. The results obtained at a processing speed of 1500 m/min are shown in Table 3. Since the twist tension was low at a drawing ratio of 1.8 times, ballooning was not stabilized in the draw texturing zone, showing poor process stability. The textured yarn obtained had extremely darkly dyed portions and streaks, showing lack of color uniformity. When the drawing ratio was raised to 1.9 times, to increase the twist tension, fluff and frequent fiber breaking occurred, to reduce considerably the processability.

TABLE 1

| | No. | Core polymer | Amount of core polymer (wt %) | Spinning speed (m/min) | Strength | Elongation | Boil off shrinkage | Birefringence |
|---|---|---|---|---|---|---|---|---|
| Example 1 | 1 | Polystyrene | 5 | 5000 | 2.1 | 173 | 43 | 0.020 |
| | 2 | (Styron 685) | | 6000 | 2.2 | 150 | 34 | 0.033 |
| Example 2 | 3 | Polystyrene | 5 | 6000 | 2.3 | 191 | 40 | 0.024 |
| | 4 | (Denka Styrol MT-2) | | 7000 | 2.3 | 165 | 40 | 0.033 |
| | 5 | | | 8000 | 2.4 | 132 | 38 | 0.040 |
| | 6 | | | 9000 | 2.6 | 115 | 35 | 0.044 |
| Example 3 | 7 | Polystyrene | 10 | 8000 | 2.0 | 190 | 45 | 0.020 |
| | 8 | (Styron 685) | 14 | 10000 | 2.0 | 195 | 44 | 0.020 |
| | 9 | | | 12000 | 2.0 | 180 | 40 | 0.025 |
| Example 4 | 10 | Polymethyl methacrylate | 5 | 6000 | 2.5 | 130 | 28 | 0.038 |
| Example 5 | 11 | Polymethylpentene | 3 | 6000 | 2.1 | 110 | 21 | 0.045 |
| Comparative Example 1 | 12 | PET | — | 2000 | 1.6 | 280 | 62 | 0.017 |
| | 13 | | | 3000 | 2.5 | 190 | 62 | 0.033 |
| | 14 | | | 3500 | 2.7 | 145 | 62 | 0.050 |
| | 15 | | | 4000 | 3.0 | 120 | 56 | 0.059 |
| | 16 | | | 5000 | 3.4 | 71 | 4 | 0.086 |
| | 17 | | | 6000 | 3.7 | 53 | 4 | 0.103 |
| Comparative Example 2 | 18 | Polyethylene | 5 | 4000 | 3.1 | 55 | 6 | 0.085 |
| Example 6 | 19 | Polystyrene | 1 | 6000 | 2.9 | 103 | 11 | 0.045 |
| | 20 | (Styron 685) | 2 | | 2.6 | 116 | 20 | 0.039 |
| | 21 | | 10 | | 1.6 | 215 | 49 | 0.015 |
| Comparative Example 3 | 22 | | 0.5 | 6000 | 3.7 | 58 | 4 | 0.098 |
| | 23 | | 17 | | 1.0 | 320 | 62 | 0.005 |

TABLE 2

| | Twist tension cN | Strength cN/dtex | Elongation % | Boil off shrinkage % | CR % | Melting point °C. | Density g/cm$^2$ |
|---|---|---|---|---|---|---|---|
| Example 7 | 41 | 4.1 | 24 | 5 | 46 | 258 | 1.369 |
| Comparative example 4 | 32 | 4.1 | 23 | 5 | 47 | 256 | 1.396 |

TABLE 3

| | Drawing ratio | Twist tension cN | Process stability and passability | Dye mottles of textured yarn |
|---|---|---|---|---|
| Example 7 | 1.8 | 44 | good | good |
| Comparative example 4 | 1.8 | 34 | Unstable ballooning, fluff | Darkly dyed portions |
| | 1.9 | 44 | and frequent breaking | and streaks |

What is claimed is:

1. A process for preparing highly oriented undrawn core-sheath type conjugated polyester fibers, comprising:

spinning a polyester as a sheath polymer and a polymer having a larger gradient of elongational viscosity with the temperature than that of the sheath polymer as a core polymer at a spinning speed of about 4000 to 12000 m/min, to form undrawn core-sheath type fibers.

2. The process for preparing highly oriented undrawn polyester fibers of claim 1, wherein the amount of the core polymer conjugated is about 1 to 15 wt % based on the weight of the entire conjugated fiber.

3. The process for preparing highly oriented undrawn polyester fibers of claim 1, wherein the amount of the core polymer conjugated is about 1 to 10 wt % based on the weight of the entire conjugated fiber.

4. The process for preparing highly oriented undrawn polyester fibers of claim 2 or 3, wherein the spinning speed is about 4000 to 9000 m/min.

5. A process for preparing highly oriented undrawn core-sheath type conjugated polyester fibers, comprising:

spinning a polyester as a sheath polymer and a polymer having a larger gradient of elongational viscosity with the temperature than that of the sheath polymer as a core polymer at a spinning speed of about 4000 to 12000 m/min, wherein the fibers are crystalline such that the fibers exhibit diffraction peaks observable in a wide angle X-ray diffraction peak image of the fibers and have a birefringence of about 0.015 to 0.05.

6. A process for preparing highly oriented undrawn core-sheath type conjugated polyester fibers, comprising:

spinning a polyester as a sheath polymer and a polymer having a larger gradient of elongational viscosity with the temperature than that of the sheath polymer as a core polymer at a spinning speed of about 4000 to 12000 m/min, wherein the fibers are crystalline such that the fibers exhibit diffraction peaks observable in a wide angle x-ray diffraction peak image of the fibers and have a birefringence of about 0.015 to 0.05, and wherein the boil off shrinkage of the fibers obtained is about 10 to 50%.

7. The process for preparing highly oriented undrawn polyester fibers of claim 5 or 6, wherein elongation of the fibers obtained is about 100 to 250%.

8. The process for preparing highly oriented undrawn polyester fibers of claim 1, wherein the sheath polyester is polyethylene terephthalate, and the polymer having the larger gradient of elongational viscosity with the temperature than that of the sheath polymer is at least one polymer selected from a group consisting of styrene based polymers, acrylate based polymers, acrylate-styrene copolymers, and methylpentene based polymers.

* * * * *